US010485357B1

(12) United States Patent
Limer et al.

(10) Patent No.: US 10,485,357 B1
(45) Date of Patent: Nov. 26, 2019

(54) FOAM MATTRESS WITH REINFORCED EDGES

(71) Applicant: Hickory Springs Manufacturing Company, Hickory, NC (US)

(72) Inventors: William Brent Limer, Hickory, NC (US); Stephen Patrick Brabandt, Hickory, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 229 days.

(21) Appl. No.: 15/489,406

(22) Filed: Apr. 17, 2017

Related U.S. Application Data

(60) Provisional application No. 62/325,691, filed on Apr. 21, 2016.

(51) Int. Cl.
*A47C 27/14* (2006.01)
*A47C 27/15* (2006.01)
*A47C 27/06* (2006.01)

(52) U.S. Cl.
CPC ..... *A47C 27/144* (2013.01); *A47C 27/06* (2013.01); *A47C 27/15* (2013.01)

(58) Field of Classification Search
CPC ..... A47C 27/14; A47C 27/16
USPC ..... 5/717, 727, 739–740
See application file for complete search history.

(56) References Cited

U.S. PATENT DOCUMENTS 5,537,699 A 7/1996 Bonaddio et al.
5,701,623 A 12/1997 May
5,960,496 A 10/1999 Boyd
6,662,393 B2 12/2003 Boyd
7,165,282 B2 1/2007 Watson
7,185,379 B2 3/2007 Barman
7,509,698 B2 3/2009 Poulos
8,266,747 B1 9/2012 Sobran et al.
8,561,236 B2 10/2013 Witherell et al.
2003/0177585 A1 9/2003 Gladney et al.
2004/0261186 A1 12/2004 Gladney
2005/0000026 A1 1/2005 Gladney
2006/0031995 A1 2/2006 Barkhouse
2007/0017034 A1 1/2007 Creekmuir
2007/0169276 A1* 7/2007 Carlitz ..... A47C 23/002 5/717
2008/0295251 A1 12/2008 Flippin
2009/0031502 A1 2/2009 Berrcocal et al.
2010/0115702 A1 5/2010 Biggie et al.
2010/0170042 A1 7/2010 Rose
(Continued)

FOREIGN PATENT DOCUMENTS

WO 2014117044 A1 7/2014

*Primary Examiner* — Fredrick C Conley
(74) *Attorney, Agent, or Firm* — Perkins Coie LLP

(57) ABSTRACT

A mattress having a foam core is provided. The foam core may include a channel along two or more sides of the foam core. Spring coils in the channel(s) provide increased localized support proximal the outer edge of the mattress. The spring coils may be conventional spring coils or individually pocketed spring coils. In certain alternatives, the spring coils may be replaced by foam different than the foam core; such difference may include foams having a higher indentation force deflection (IFD) rating. The mattress may have a foam core that is provided with an undercut filled with a foam insert where a higher IFD foam is provided in the undercut.

20 Claims, 3 Drawing Sheets

(56) References Cited

U.S. PATENT DOCUMENTS

| | | | | |
|---|---|---|---|---|
| 2013/0025068 | A1* | 1/2013 | Chunglo ..... | A47C 27/14<br>5/739 |
| 2013/0025069 | A1 | 1/2013 | Ruehlmann et al. | |
| 2013/0291312 | A1 | 11/2013 | Bell, Jr. | |
| 2014/0165292 | A1 | 6/2014 | Gladney et al. | |

* cited by examiner

FOAM MATTRESS WITH REINFORCED EDGES

CROSS-REFERENCE TO RELATED PATENT APPLICATIONS

The present application claims priority to U.S. Provisional Patent Application Ser. No. 62/325,691, filed on Apr. 21, 2016, the disclosure of which is incorporated herein as if set out in full.

BACKGROUND

Foam mattresses are, and have been, one of the more popular types of mattresses for home and personal use. The comfort of a foam mattress is one of several possible reasons for foam mattresses to be popular. The comfort of the foam mattress, however, can be detrimental to functionality in certain aspects. For example, some foam mattresses may be very comfortable and supportive while a person is in a supine position and at rest. When the person sits on the edge of the bed, however, the foam mattresses compress at the edges and provide relatively less support. The person sitting at the edge may feel the mattress sag or feel as if they were going to slip off of the mattress. The sag or compression of the mattress under localized concentration of weight is sometimes referred to as "bottoming out."

Against the above background, it would be desirous to provide a foam mattress with a reinforced edge.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

In some aspects of the technology, a mattress having a foam core is provided. The foam core may include a channel along two or more sides of the foam core. Spring coils in the channel(s) provide increased localized support proximal the outer edge of the mattress. The spring coils may be conventional spring coils or individually pocketed spring coils. In certain alternatives, the spring coils may be replaced by foam different than the foam core; such difference may include foams having a higher indentation force deflection (IFD) rating.

In other aspects of the technology, a mattress having a foam core is provided. The foam core has a top side and a bottom side. For orientation, the bottom side would be ground facing. The foam core mattress may have a side shoulder along two or more sides of the foam core. The side shoulder may be formed by a cutaway of a formed mattress or a shaped poured. The side shoulder provides a support surface for spring coils or foams having a higher IFD.

In still other aspects of the technology, the foam core of a mattress may be provided with an angular cutaway where a higher IFD foam is provided in the cutaway.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

The technology of the present application will now be described more fully below with reference to the accompanying figures, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense.

The technology of the present application is described with specific reference to foam mattresses having reinforced or resilient edges. However, the technology described herein may be used for other foam cushions or applications. For example, the technology of the present application may be applicable to tumbling pads, yoga mats, sofa cushions, or the like. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

Figure 5:
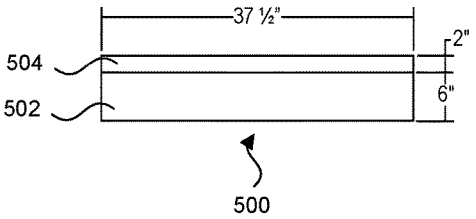
FIG. 5 (Prior Art)
FIGS. 5 and 6 show prior art mattresses.
Figure 6:
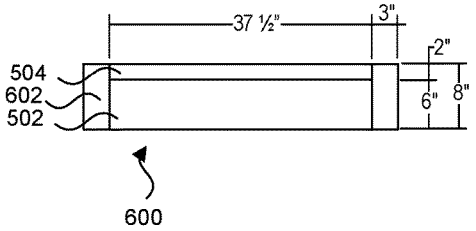
FIG. 6 (Prior Art)

With reference now to FIGS. 5 and 6, conventional foam mattresses 500, 600 are described for reference. The foam mattresses 500, 600 generally include a support layer 502 and a top layer 504. The foam mattress 500 is shown having a width of 37.5 inches. The foam mattress 600 is shown having a total width of 37.5 inches.

The support layer 502 is shown as a single layer, but may comprise multiple layers of foams including reticulated foams, polyurethane foams, closed cell foams, viscoelastic foams, latex foam, or the like. In each case, the foams may be natural or synthetic. In certain embodiments, the support layer 502 may include air layers, spring layers, or water layers as a matter of configuration. The foam mattresses 500, 600 have a height h that may range from about 3 or 4 inches to a total of 25 inches or more in certain embodiments. The support layer 502 comprises the majority of the height of the foam mattresses 500, 600. For example, in this particular exemplary embodiment, the foam mattresses 500, 600 have a total height of 8 inches where the support layer 502 comprises approximately 6 inches.

The top layer 504 is generally for comfort and/or feel while in a supine or sleeping position. The top layer 504 may be specifically designed for comfort, feel, and support. The top layer 504 may be a viscoelastic foam, a latex foam, a combination thereof, or the like in certain embodiments. The top layer 504 (sometimes referred to as the sleep surface or sleep layer) generally makes up a minority of the total height of the mattresses 500, 600. In the exemplary embodiments, the top layer 504 is approximately 2 inches.

Foam mattress 600 is similar to foam mattress 500 and includes the support layer 502 and top layer 504. The foam mattress 600 includes an outer casing 602. Typically, the outer casing 602 is a conventional foam and could be a reticulated foam layer for breathability. The outer casing 602, in this exemplary embodiment, has a height of 8 inches and a width of 3 inches. Thus, the top layer 504 has a total width of 31.5 inches.

Figure 1:
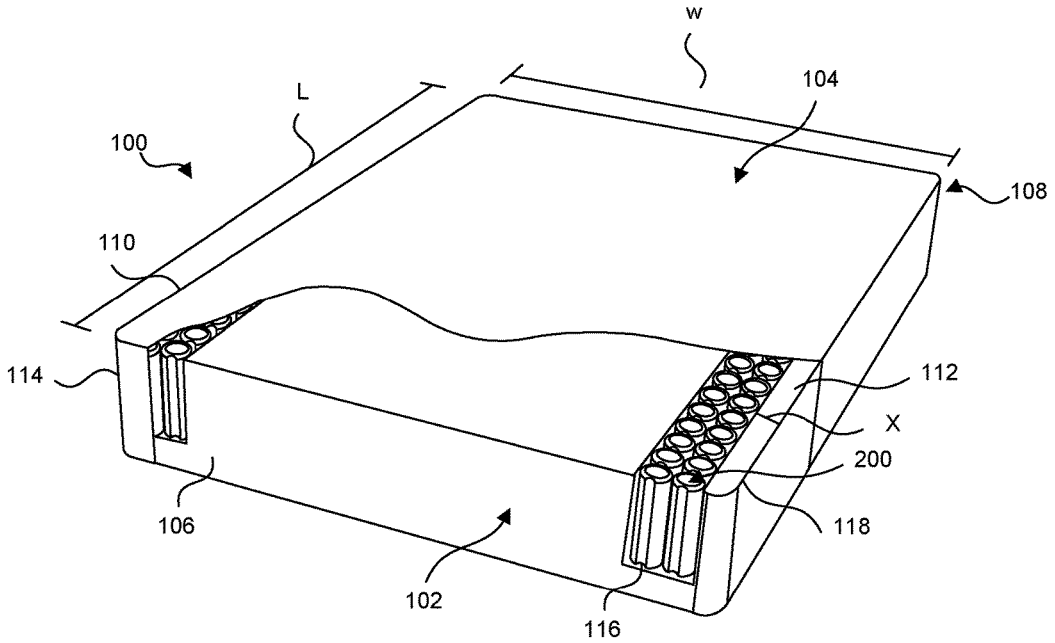
FIG. 1 is a perspective view of a mattress constructed in accordance with an aspect of the technology of the present application.

With reference now to FIG. 1, a foam mattress 100 constructed in accordance with the technology of the present application is provided. The foam mattress 100 includes a foam core 102, which foam core 102 could include a top layer and a support layer or be any of the prior art constructions identified above. The foam core 102 is considered a monolithic foam mass for convenience. The foam mattress 100 is shown with a mattress cover 104 or envelope 104 that may be provided. The foam mattress 100 may have beveled or chamfered corners.

The foam mattress 100 includes a head 106 and a foot 108. The head 106 and the foot 108 are generally adjacent to a head board and foot board of a bed, not shown for convenience. The foam mattress 100 includes a left side 110 and a right side 112, as oriented by a person supine on the foam mattress facing upwards with the person's head proximal the head 106 of the foam mattress.

The foam core 102 includes a pair of channels 114, 116. Channel 114 is located on the left side 110 and channel 116 is located on the right side 112. The channels extend a length L of the foam mattress 100. In certain embodiments, the channels may extend substantially the entire length L. Additional channels could be formed only in the head 106 and the foot 108, but those channels are not provided in this exemplary embodiment as a person would generally not sit on the edge of foam mattress 100 over the head or foot boards. The channels on the head and the foot of the bed would be along the width W of the foam mattress 100.

The channels 114, 116 are generally formed inward from the edge 118 of the foam mattress a distance X. The distance X may be between about 1 and 6 inches.

Figure 2:
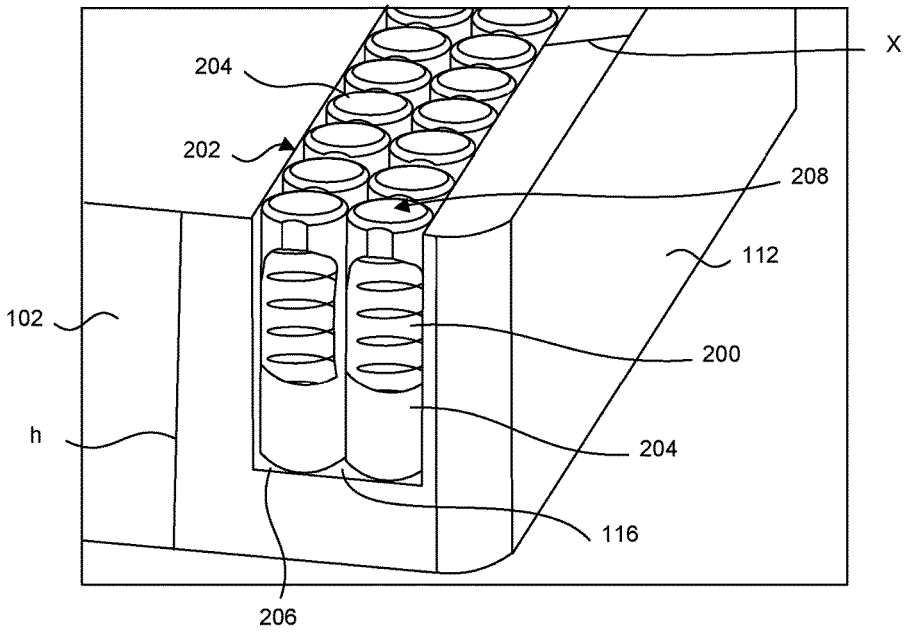
FIG. 2 shows a spring coil consistent with the mattress of FIG. 1.

With reference now to FIG. 2, the channel 116 is shown in more detail. The channel 114 is substantially similar to channel 116. The channel 116 is formed with an opening 202 in the top surface of foam core 102. Two opposed sidewalls 204 extend vertically downward part of the height h of the foam core 102. The channel 116 also includes a floor 206 opposite the opening 202.

Spring coils 200 are placed in the channel 116 (and similarly in the channel 114). The spring coils 200 may be left turn coils or right turn coils as are generally known in the industry. In one exemplary embodiment, the coils are alternatively left and right turn coils. As shown in the exemplary embodiment, the coils 200 are arranged side by side in a matrix of two (2) columns having a number of rows. Alternatively, the two (2) columns may be offset. More than two parallel or offset columns of spring coils 200 are possible. The spring coils 200 may be pocketed in a pocket 208, as is generally known in the art, such that each coil 200 is an individually pocketed coil 200 in a pocket 208.

The height of the spring coil 200 (whether pocketed or not) is substantially the same as the depth of the channel 116. Generally, the spring coils 200 have a greater IFD than the foam associated with the foam core 102.

Alternatively to the spring coils 200, a foam insert (not specifically shown in FIGS. 1 and 2) could be provided to fit within the volume provided by the channels 114, 116. The foam insert would have a higher IFD than the foam associated with the foam core 102. The IFD of the foam insert would generally be between about 20 and 75 IFD and be higher than the IFD of the foam core 102.

The opposed sidewalls 204 of the channel 116 provide force tending to help keep the spring coils 200 vertically aligned. Thus, having the channel 116 oriented the distance X from the edge may resist splaying of the coils 200.

Figure 3:
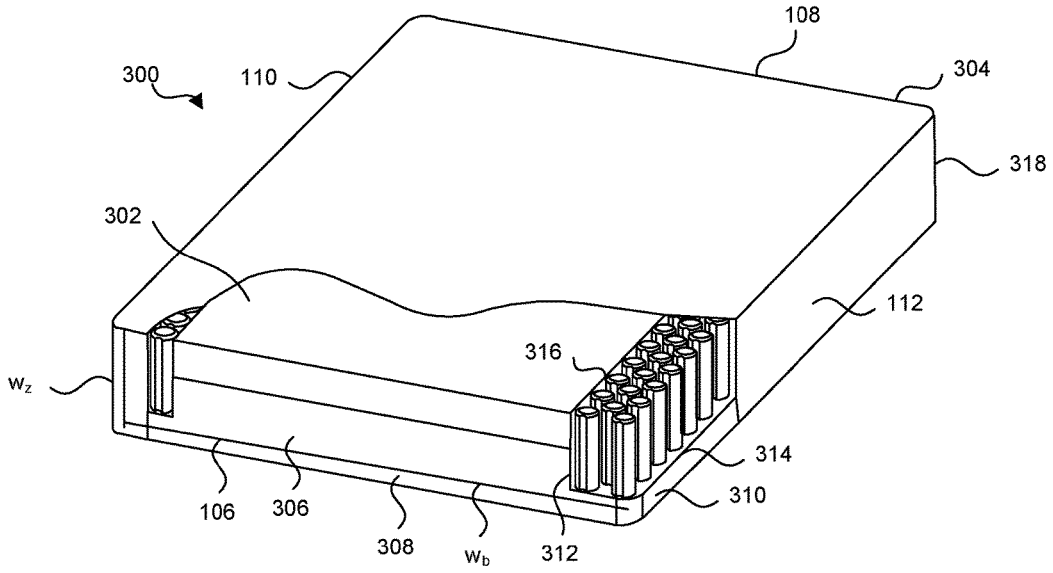
FIG. 3 shows a perspective view of a mattress constructed in accordance with an aspect of the technology of the present application.

With reference now to FIG. 3, another foam mattress 300 constructed in accordance with the technology of the present application is provided. The foam mattress 300 includes a foam core 302 and mattress cover 304, both of which may be similar in construct to the above described. The foam mattress 300 includes the head 106, the foot 108, the left side 110, and the right side 112.

The foam core 302 has a top portion 306 and a bottom portion 308 (which portions may individually be comprised of one or more layers of foam). The bottom portion 308 has a width Wb greater than a width Wt of the top portion forming a shelf 310 along each of the left side 110 and the right side 112. The shelf 310 has a sidewall 312 formed from the outer side of the top portion 310 and a bottom 314 formed from the upper side of the bottom portion 308.

The shelf 310 supports spring coils 316, which are shown as individually pocketed spring coils. The mattress cover 304 provides support to the spring coils 316 on the outer side edge 318 to inhibit splaying of the coils 316.

The spring coils 316 are arranged with three staggered columns where the outer two columns have parallel rows and the middle column is offset. The spring coils could be arranged with two parallel columns as described above or provide additional columns. The additional columns could alternative such that every odd column (outside in) is arranged at a first location and every even column (outside in) is arranged offset from the odd columns.

Figure 4:
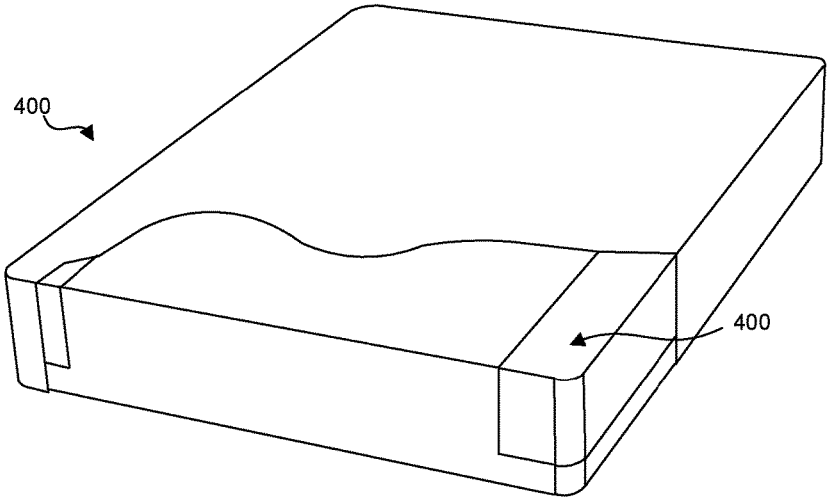
FIG. 4 shows a perspective view of a mattress constructed in accordance with an aspect of the technology of the present application.

FIG. 4 provides a foam mattress 400 that is similar to foam mattress 300. Foam mattress 400 uses a foam insert on the shelf 310 rather than spring coils 316. The foam mattress would have an IFD greater than the foam core 302 IFD. In one exemplary embodiment, the foam insert having a 45 IFD provided satisfactory results. An IFD between about 20 IFD and 75 IFD would work satisfactorily. The spring coils would have a similar comparative hardness.

Figure 7:
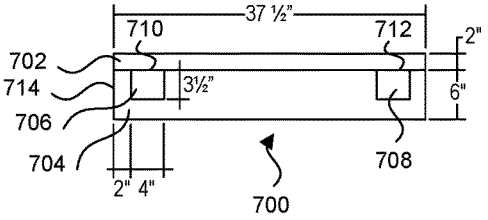
FIG. 7 shows a cross sectional view (across the width) of a mattress constructed in accordance with the technology of the present application.

The foam mattresses of FIGS. 1-4 show exemplary embodiments of the technology of the present application where the edge support (be it spring coils or foam inserts) is open to the top end of the foam core. The edge support is covered by a mattress cover. FIG. 7 shows an alternative construction where the foam mattress 700 includes a top layer 702 and a support layer 704. The top layer 702, which may be any combination of foam but is typically a viscoelastic or latex foam, resides atop the support layer 704. A left channel 706 and a right channel 708, similar to the channels 114, 116 above, are formed in the support layer 704. The top layer 702 covers the open end 710 of the left channel and the open end 712 of the right channel. A plurality of spring coils (not specifically shown in FIG. 7) are provided in the channels 706, 708.

Figure 8:
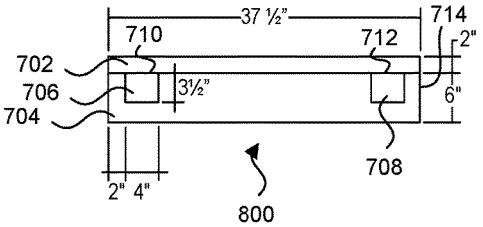
FIG. 8 shows a cross sectional view (across the width) of a mattress constructed in accordance with the technology of the present application.

The cross-section of the foam mattress 700 shown in FIG. 7 provides a foam mattress 700 with a height of 8 inches. The top layer is provided with a height of 2 inches and the support layer is provided with a height of 6 inches. The left and right channels 706, 708 are provided with a depth of 3.5 inches in this exemplary embodiment. In other words, the depth of the channels is over ½ the depth of the support layer beneath the top layer 702 in this exemplary embodiment. As shown in this exemplary embodiment, the channels 706, 708 are approximately 2 inches from the edge 714 of the foam mattress 700 and the channels have a width of approximately 4 inches. The channels 706, 708 may be inset from the edge 714 anywhere between about 1 and 6 inches. The channel width depends on the spring coil arrangement or foam insert in part. FIG. 8 shows a mattress 800 similar in most respects to mattress 700. The similarities will not be re-explained herein. The spring coils are replaced, however, with a foam insert in the channels 706, 708.

Figure 9:
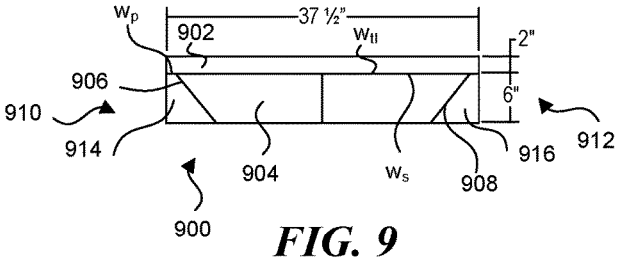
FIG. 9 shows a cross sectional view (across the width) of a mattress constructed in accordance with the technology of the present application.

FIG. 9 provides an alternative foam mattress 900. Form mattress 900 includes the top layer 902, which may be latex, viscoelastic, or a composite of foams designed for comfort and support among other things. The top layer 902 rests on a support layer 904, which is shown as two slabs of foam in this exemplary embodiment. The support layer 904, beneath the top layer 902, has a pair of diagonal cut outs 906, 908 on the left and right sides 910, 912 of the support layer 904 such that the support layer 904 forms a trapezoidal shape with the longest side being the width Ws of the support layer 904 proximal the top layer 902. Notably, the width Ws of the support layer 904 is slightly less than the width Wtl of the top layer 902, typically by 0.5 to 2.5 inches, but about 1 inch in this exemplary embodiment. A generally wedged shape foam insert 914, 916 is provided having a higher IFD than the support layer 904 operative fits into the cut outs 906, 908. The wedge shape foam insert forms a trapezoidal shape with such that the surface proximal to the top layer 902 has a width Wp. The sum Wp, Ws, Wp is substantially equal to Wtl. The wedge shape foam insert may, in certain embodiments, come to a sharp edge, but the concentration may limit the ability of the insert to provide additional support.

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

The invention claimed is:

1. A mattress having reinforced edges, comprising:

a mattress having a head, a foot, and a pair of opposed sides formed from a foam core having a first indentation force deflection (IFD) rating, the mattress having a mattress length, mattress width, and mattress height;

at least a pair of channels formed internal to and parallel with the opposed sides of the mattress, the channels each having a contiguous channel length substantially from the head to the foot of the mattress, a channel width less than the mattress width, and a channel height less than the mattress height, each of the channels being formed by opposed sidewalls, a bottom, and an open top wherein the opposed sidewalls and the bottom are formed by the foam core;

a plurality of spring coils in at least two columns for each channel, wherein each of the plurality of spring coils has a coil height equal to the channel height residing in the pair of channels, the plurality of spring coils having a second IFD rating greater than the first IFD; and an envelope encasing the mattress, pair of channels, and the plurality of spring coils wherein the envelope such that the envelope inhibits the plurality of spring coils from splaying.

2. The mattress of claim 1 wherein the plurality of spring coils are individually pocketed spring coils.

3. The mattress of claim 1 wherein the foam core comprises at least a top layer and a support layer.

4. The mattress of claim 3 wherein the top layer comprises latex foam.

5. The mattress of claim 3 wherein the top layer comprises viscoelastic foam.

6. The mattress of claim 1 wherein the plurality of channels are each offset from the corresponding side by about 1 inch.

7. The mattress of claim 1 wherein the plurality of channels are offset from the corresponding side by no more than 6 inches.

8. The mattress of claim 7 wherein the plurality of channels are offset from the corresponding side by no less than 1 inch.

9. The mattress of claim 1 wherein the second IDF rating is at least 25.

10. The mattress of claim 1 wherein the second IDF rating is no more than 75.

11. A mattress having reinforced edges, comprising:

a mattress having a head, a foot, and a pair of opposed sides formed from at least a top layer and a support layer, the top layer having a first indentation force deflection (IFD) rating, the mattress having a mattress length, a mattress width, and a mattress height;

at least a pair of channels formed internal to and parallel with the opposed sides of the support layer of the mattress, each of the channels having a contiguous channel length substantially from the head to the foot of the mattress, a channel width less than the mattress width, and a channel height less than the mattress height, each of the channels being formed by opposed sidewalls, a bottom, and an open top wherein the opposed sidewalls and the bottom are formed by the support layer, each of the pair of channels formed parallel to and contiguously along a corresponding one of the pair of opposed sides, wherein each of the channels is located in the support layer about 1 inch to 2 inches from one of the pair of opposed sides and wherein the top layer overlies the open top of the channel formed in the support layer;

a support member residing in each of the pair of channels and having a support member height equal to the channel height, the support member having a second IFD rating greater than the first IFD; and an envelope encasing the mattress, pair of channels, and the support such that the envelope inhibits the support member from splaying.

12. The mattress of claim 11 wherein the support member is a plurality of spring coils.

13. The mattress of claim 12 wherein the support member is a foam insert having a second IFD rating between about 25 and 75.

14. The mattress of claim 13 wherein the second IFD rating is about 45.

15. The mattress of claim 11 wherein the top layer comprises a latex foam.

16. The mattress of claim 11 wherein the top layer comprises a viscoelastic foam.

17. The mattress of claim 11 wherein the support layer comprises at least a foam having a third IFD rating greater than the first IFD rating but less than the second IFD rating.

18. A mattress having reinforced edges, comprising:

a mattress having a head, a foot, and a pair of opposed sides formed from a foam core having a first indentation force deflection (IFD) rating, the foam core having a foam core length and foam core height; the foam core having a first foam core width at a top of the foam core and a second foam core width at the bottom of the foam core wherein the second foam core width is less than the first foam core width forming a pair of shaped undercuts, wherein each of the shaped undercuts forms a shelf extending from the foam core and wherein the foam core forms a sidewall adjacent the shelf;

a pair of foam inserts having a second IFD rating greater than the first IFD rating and shaped to fill the undercut supported by the shelf; and an envelope encasing the mattress and the foam insert, wherein the envelop forms a sidewall to hold each of the foam inserts in place on the shelf.

19. The mattress of claim 18 wherein a cross section of the shaped undercut is a right triangle with a hypotenuse formed by the mattress.

20. The mattress of claim 18 wherein the mattress comprises a top layer and a support layer and the shaped undercut is formed only in the support layer.

* * * * *